US006673206B1

(12) United States Patent
Linhart et al.

(10) Patent No.: US 6,673,206 B1
(45) Date of Patent: Jan. 6, 2004

(54) METHOD OF PRODUCING PAPER, PAPERBOARD AND CARDBOARD

(75) Inventors: Friedrich Linhart, Heidelberg (DE); Bernd Dirks, Hessheim (DE); Rainer Tresch, Maxdorf (DE); Bernhard Mohr, Heidelberg (DE); Dietrich Fehringer, Dielheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 10/069,719

(22) PCT Filed: Aug. 16, 2000

(86) PCT No.: PCT/EP00/07984

§ 371 (c)(1),
(2), (4) Date: Feb. 28, 2002

(87) PCT Pub. No.: WO01/16425

PCT Pub. Date: Mar. 8, 2001

(30) Foreign Application Priority Data

Aug. 28, 1999 (DE) ..... 199 40 955

(51) Int. Cl.[7] ..... D21H 17/55; D21H 21/10

(52) U.S. Cl. ..... 162/164.3; 162/164.3; 162/164.6

(58) Field of Search ..... 162/164.3, 164.6, 162/164.1

(56) References Cited

U.S. PATENT DOCUMENTS

| | | | | | |
|---|---|---|---|---|---|
| 3,086,961 | A | * | 4/1963 | House et al. | 162/164.6 |
| 3,250,664 | A | * | 5/1966 | Conte et al. | 162/164.6 |
| 3,526,608 | A | * | 9/1970 | Berg et al. | 162/164.6 |
| 3,535,288 | A | * | 10/1970 | Lipowski et al. | 162/164.6 |
| 3,640,840 | A | * | 2/1972 | Ziemann et al. | 162/164.6 |
| 3,642,572 | A | * | 2/1972 | Endres et al. | 162/164.6 |
| 3,761,350 | A | * | 9/1973 | Munjat et al. | 162/164.6 |
| 3,869,342 | A | * | 3/1975 | Munjat et al. | 162/164.6 |
| 3,893,885 | A | * | 7/1975 | Ziemann et al. | 162/164.6 |
| 4,035,229 | A | * | 7/1977 | Rave | 162/164.6 |
| 4,036,821 | A | * | 7/1977 | Hoppe et al. | 162/164.6 |
| 4,250,299 | A | * | 2/1981 | Lehmann et al. | 162/164.6 |
| 5,556,938 | A | | 9/1996 | Freeman et al. | |

FOREIGN PATENT DOCUMENTS

DE 268357 5/1989

OTHER PUBLICATIONS

J.C. Roberts, ed.: Paper Chemistry Blackie Academie & Professional, London, 2nd edition, 1996.
C.O. Au et al, ed.: Applications of Wet–End Paper Chemistry Blackie Academie & Professional, London 1995.

* cited by examiner

*Primary Examiner*—Peter Chin
(74) *Attorney, Agent, or Firm*—Oblon, Spivak, McClelland, Maier & Neustadt, P.C.

(57) ABSTRACT

Paper, board and cardboard are produced by a process in which a paper stock is drained in the presence of condensates of basic amino acids with sheet formation. In particular, homo- and cocondensates of lysine and the crosslinked condensates obtainable therefrom by reaction with crosslinking agents are used in amounts of from 0.01 to 5% by weight, based on dry paper stock, as a means of increasing the dry and wet strength and the absorptivity of paper, for fixing anionic dyes and interfering substances in the paper, for increasing the drainage rate and the retention as well as the efficiency of synthetic anionic and cationic retention aids in the production of paper, board and cardboard by draining a paper stock with sheet formation.

8 Claims, No Drawings

METHOD OF PRODUCING PAPER, PAPERBOARD AND CARDBOARD

The present invention relates to a process for the production of paper, board and cardboard by draining a paper stock in the presence of polymers.

It is generally known that paper comprises essentially fibers, consisting of wood and/or of cellulose, and, if required, of mineral fillers, in particular calcium carbonate and/or aluminum silicate, and that the essential papermaking process consists of separating these fibers and fillers from a dilute aqueous suspension of these substances by means of one or more movable wires. It is also known that certain chemicals are added to the suspension of fibers and fillers in water, both for improving the separation process and for achieving or improving certain properties of the paper. A very current review of the generally used paper chemicals and their use is to be found, for example, in—*Paper Chemistry*, J. C. Roberts ed., Blackie Academic & Professional, London, Second edition 1996, —and in—*Applications of Wet-End Paper Chemistry*, C.O. Au and I. Thorn eds., Blackie Academic & Professional, London, 1995.

As is evident from the literature cited, many of the paper chemicals used are cationic water-soluble polymers or, in other words, cationic polyelectrolytes or polycations having, preferably, an average or high molar mass. These products are added to the very dilute paper fiber slurry before the paper sheet forms therefrom on the wire. Depending on their composition, they result, for example, in more fine material remaining behind on the wire or in the separation of the water on the wire taking place more rapidly or in certain substances being fixed to the paper fibers and hence not entering the white water, and, in the case of the last property, both the cleanliness of the white water and the effect of the fixed substances, e.g. dyes or sizes, on the properties of the finished paper may be important. However, polycations may also increase the strength of the paper or impart improved residual strength to the paper in the wet state. However, this wet strength is generally obtained by using polycations which additionally carry reactive groups which react with the paper components or with themselves with network formation and, owing to the resulting covalent bonds, make the paper more resistant to water.

U.S. Pat. No. 5,556,938 discloses that the thermal polycondensation of amino acids is carried out in the presence of organic or inorganic acids. For example, aspartic acid, alanine, arginine, glycine, lysine and tryptophan are mentioned as amino acids. The condensates thus obtainable are used, for example, in detergents and cleaning agents, as scale inhibitor, as dispersants for pigments and as dispersants in papermaking.

U.S. Pat. No. 3,869,342 discloses cationic, heat-curable resins based on polyamidoamines, which resins can be crosslinked by reaction with epichlorohydrin and can be cured by heating. Resins of this type are used, for example, as wetstrength agents in papermaking.

The polycations used according to the prior art for said purposes are almost exclusively polymers of synthetic origin, i.e. products based on petrochemicals. Important exceptions, however, are the cationic starches, which originate from the reaction of a plant-based raw material with a synthetic cationizing agent. In rare cases, other polysaccharides modified with synthetic cationizing agents are also used in papermaking, for example cationic guar flour. The literature also describes, as the cationic paper assistant, the polysaccharide chitosan, which is obtained by chemical reaction with chitin from crustaceans, but no permanent practical application is known to date.

Regardless of their specific action profiles, products based on vegetable or animal starting materials frequently have the advantage of being more readily biodegradable on reintroduction into the natural cycle. The use of plant-based raw materials also helps to protect fossil resources and to reduce carbon dioxide emission.

The polycations based on renewable raw materials and suitable to date as paper chemicals are exclusively polysaccharides having a very narrow action profile. The principally used cationic starches are employed for increasing the dry strength of the paper and, to a lesser extent, also as retention aids.

It is an object of the present invention to provide further substances which are based on natural raw materials and, for example, fix anionic substances in the paper in papermaking and improve the retention of fillers.

We have found that this object is achieved, according to the invention, by a process for the production of paper, board and cardboard by draining a paper stock in the presence of polymers with sheet formation, if the polymers used are crosslinked condensates which are obtainable by reaction of (i) homocondensates of basic amino acids, condensates of at least two basic amino acids and/or cocondensates of basic amino acids and cocondensable compounds with (ii) at least one crosslinking agent having at least two functional groups.

Condensates are derived, for example, from homo- or cocondensates of lysine, arginine, ornithine and/or tryptophan. They are obtainable, for example, by condensing (a) lysine, arginine, ornithine, tryptophan or mixtures thereof with (b) at least one compound cocondensable therewith.

The polymers are prepared by condensation of (a) lysine, arginine, ornithine, tryptophan or mixtures thereof with (b) at least one compound selected from the group consisting of the monoamines, diamines, triamines, tetraamines, monoaminocarboxylic acids, lactams, aliphatic aminoalcohols, urea, guanidine, melamine, carboxylic acids, carboxylic anhydrides, diketenes, nonproteinogenic amino acids, alcohols, alkoxylated alcohols, alkoxylated amines, amino sugars, sugars and mixtures thereof.

Of particular industrial interest here are cocondensates which are obtainable by condensation of (a) lysine and (b) at least one compound selected from the group consisting of the $C_6$- to $C_{18}$-alkylamines, lactams having 5 to 13 carbon atoms in the ring, nonproteinogenic amino acids, monocarboxylic acids, polybasic carboxylic acids, carboxylic anhydrides and diketenes.

The compounds of groups (a) and (b) are used, for example, in a molar ratio of from 100:1 to 1:20, preferably from 100:1 to 1:5, in general from 10:1 to 1:2, in the condensation.

Suitable polymers for papermaking are crosslinked condensates of basic amino acids. Such crosslinked condensates are obtainable, for example, by reaction of (i) homocondensates of basic amino acids and/or condensates of at least two basic amino acids and/or cocondensates of basic amino acids and cocondensable compounds with (ii) at least one crosslinking agent having at least two functional groups.

The basic amino acids lysine, arginine, ornithine and tryptophan which are suitable in the condensation as compounds of group (a) can be used in the condensation in the form of the free bases, of the hydrates, of the esters with $C_1$- to $C_4$-alcohols and of the salts, such as sulfates, hydrochlorides or acetates. Lysine hydrate and aqueous solutions of lysine are preferably used. Lysine may also be used in the form of the cyclic lactam, α-amino-ε-caprolactam. Lysine mono- or dihydrochlorides or mono- or dihydrochlorides of lysine esters can also be used. If the salts of compounds of group (a) are used, the equivalent amounts of inorganic bases, e.g. sodium hydroxide solution, potassium hydroxide or magnesium oxide, are preferably used in the condensation. The alcohol components of mono- and dihydrochlorides of lysine esters are derived, for example, from low-boiling alcohols, e.g. methanol, ethanol, isopropanol or tert-butanol. Preferably, L-lysine dihydrochloride, DL-lysine monohydrochloride and L-lysine monohydrochloride are used in the condensation.

Examples of cocondensable compounds of group b) are aliphatic or cycloaliphatic amines, preferably methylamine, ethylamine, propylamine, butylamine, pentylamine, hexylamine, heptylamine, octylamine, nonylamine, decylamine, undecylamine, dodecylamine, tridecylamine, stearylamine, palmitylamine, 2-ethylhexylamine, isononylamine, hexamethylenediamine, dimethylamine, diethylamine, dipropylamine, dibutylamine, dihexylamine, ditridecylamine, N-methylbutylamine, N-ethylbutylamine, cyclopentylamine, cyclohexylamine, N-methylcyclohexylamine, N-ethylcyclohexylamine and dicyclohexylamine.

Suitable diamines, triamines and tetraamines are preferably ethylenediamine, propylenediamine, butylenediamine, neopentyldiamine, hexamethylenediamine, octamethylenediamine, imidazole, 5-amino-1,3-trimethylcyclohexylmethylamine, diethylenetriamine, dipropylenetriamine and tripropyltetraamine. Further suitable amines are 4,4'-methylenebiscyclohexylamine, 4,4'-methylenebis-(2-methylcyclohexylamine), 4,7-dioxadecyl-1,10-diamine, 4,9-dioxadodecyl-1,12-diamine, 4,7,10-trioxatridecyl-1,13-diamine, 2-(ethylamino)ethylamine, 3-(methylamino)propylamine, 3-(cyclohexylamino)propylamine, 3-(2-aminoethyl)aminopropylamine, 2-(diethylamino)ethylamine, 3-(dimethylamino)propylamine, dimethyldipropylenetriamine, 4-aminomethyloctane-1,8-diamine, 3-(diethylamino)propylamine, N,N-diethyl-1,4-pentanediamine, diethylenetriamine, dipropylenetriamine, bis(hexamethylene)triamine, aminoethylpiperazine, aminopropylpiperazine, N,N-bis(aminopropyl)methylamine, N,N-bis(aminopropyl)ethylamine, N,N-bis(aminopropyl)hexylamine, N,N-bis(aminopropyl)octylamine, N,N-dimethyldipropylenetriamine, N,N-bis(3-dimethylaminopropyl)amine, N,N'-1,2-ethanediylbis(1,3-propanediamine), N-(hydroxyethyl)piperazine, N-(aminoethyl)piperazine, N-(aminopropyl)piperazine, N-(aminoethyl)morpholine, N-(aminopropyl)morpholine, N-(aminoethyl)imidazole, N-(aminopropyl)imidazole, N-(aminoethyl)hexamethylenediamine, N-(aminopropyl)hexamethylenediamine, N-(aminoethyl)ethylenediamine, N-(aminopropyl)ethylenediamine, N-(aminoethyl)butylenediamine, N-(aminopropyl)butylenediamine, bis(aminoethyl)piperazine, bis(aminopropyl)piperazine, bis(aminoethyl)hexamethylenediamine, bis(aminopropyl)hexamethylenediamine, bis(aminoethyl)ethylenediamine, bis(aminopropyl)ethylenediamine, bis(aminoethyl)butylenediamine, bis(aminopropyl)butylenediamine, and oxypropylamines, preferably hexyloxyamine, octyloxyamine, decyloxyamine and dodecyloxyamine.

Aliphatic amino alcohols are, for example, 2-aminoethanol, 3-amino-1-propanol, 1-amino-2-propanol, 2-(2-aminoethoxy)ethanol, 2-[(2-aminoethyl)amino]ethanol, 2-methylaminoethanol, 2-(ethylamino)ethanol, 2-butylaminoethanol, diethanolamine, 3-[(hydroxyethyl)amino]-1-propanol, diisopropanolamine, bis(hydroxyethyl)aminoethylamine, bis(hydroxypropyl)aminoethylamine, bis(hydroxyethyl)aminopropylamine and bis(hydroxypropyl)aminopropylamine.

Suitable monoaminocarboxylic acids are preferably glycine, alanine, sarcosine, asparagine, glutamine, 6-aminocaproic acid, 4-aminobutyric acid, 11-aminolauric acid and lactams having 5 to 13 carbon atoms in the ring, such as caprolactam, laurolactam or butyrolactam. Glucosamine, melamine, urea, guanidine, polyguanidine, piperidine, morpholine, 2,6-dimethylmorpholine and tryptamine are also suitable. Particularly preferably used polymers are those which are obtainable by condensation of a) lysine with b) hexamethylenediamine, octylamine, monoethanolamine, octamethylenediamine, diaminododecane, decylamine, dodecylamine, caprolactam, laurolactam, aminocaproic acid, aminolauric acid or mixtures thereof.

Further cocondensable compounds b) are, for example, saturated monocarboxylic acids, unsaturated monocarboxylic acids, polybasic carboxylic acids, carboxylic anhydrides, diketenes, monohydroxycarboxylic acids, monobasic polyhydroxycarboxylic acids and mixtures of said compounds. Examples of saturated monobasic carboxylic acids are formic acid, acetic acid, propionic acid, butyric acid, valeric acid, caproic acid, octanoic acid, nonanoic acid, lauric acid, palmitic acid, stearic acid, arachidic acid, behenic acid, myristic acid, 2-ethylhexanoic acid and all naturally occurring fatty acids and mixtures thereof.

Examples of unsaturated monobasic carboxylic acids are acrylic acid, methacrylic acid, crotonic acid, sorbic acid, oleic acid, linoleic acid and erucic acid. Examples of polybasic carboxylic acids are oxalic acid, fumaric acid, maleic acid, malonic acid, succinic acid, itaconic acid, adipic acid, aconitic acid, azeleic acid, pyridinedicarboxylic acid, furandicarboxylic acid, phthalic acid, terephthalic acid, diglycolic acid, glutaric acid, substituted $C_4$-dicarboxylic acids, sulfosuccinic acid, $C_1$- to $C_6$-alkylsuccinic acids, $C_2$–$C_{26}$-alkenylsuccinic acids, 1,2,3-propanetricarboxylic acid, 1,1,3,3-propanetetracarboxylic acid, 1,1,2,2-ethanetetracarboxylic acid, 1,2,3,4-butanetetracarboxylic acid, 1,2,2,3-propanetetracarboxylic acid, 1,3,3,5-pentanetetracarboxylic acid, 1,2,4-benzenetricarboxylic acid and 1,2,4,5-benzenetetracarboxylic acid. Examples of suitable carboxylic anhydrides are mono- and dianhydrides of butanetetracarboxylic acid, phthalic anhydride, acetylcitric anhydride, maleic anhydride, succinic anhydride, itaconic anhydride and aconitic anhydride.

Particularly preferred polymers are those which are obtainable by condensation of a) lysine with b) lauric acid, palmitic acid, stearic acid, succinic acid, adipic acid, ethylhexanoic acid or mixtures thereof.

Other suitable components b) are alkyldiketenes having 1 to 30 carbon atoms in the alkyl group and diketene itself. Examples of alkyldiketenes are methyldiketene, hexyldiketene, cyclohexyldiketene, octyldiketene, decyldiketene, dodecyldiketene, palmityldiketene, stearyldiketene, oleyldiketene, octadecyldiketene, eicosyldiketene, docosyldiketene and behenyldiketene.

Examples of monohydroxycarboxylic acids are malic acid, citric acid and isocitric acid. Polyhydroxycarboxylic acids are, for example, tartaric acid, gluconic acid, bis (hydroxymethyl)propionic acid and hydroxylated unsaturated fatty acids, for example dihydroxystearic acid.

Other suitable components b) are nonproteinogenic amino acids, for example anthranilic acid, N-methylamino-substituted acids, such as N-methylglycine, dimethylaminoacetic acid, ethanolaminoacetic acid, N-carboxymethylaminocarboxylic acid, nitrilotriacetic acid, ethylenediamineacetic acid, ethylenediaminetetraacetic acid, diethylenetriaminepentaacetic acid, hydroxyethylenediaminetriacetic acid, diaminosuccinic acid, and $C_4$- to $C_{26}$-aminoalkylcarboxylic acids, for example 4-aminobutyric acid, 6-aminocaproic acid and 11-aminoundecanoic acid. The acids can be used in the condensation in the form of the free acids or in the form of their salts with alkali metal bases or amines.

Other suitable components b) are alcohols, for example monohydric alcohols having 1 to 22 carbon atoms in the molecule, such as methanol, ethanol, n-propanol, isopropanol, n-butanol, isobutanol, tert-butanol, n-pentanol, hexanol, 2-ethylhexanol, cyclohexanol, octanol, decanol, dodecanol, palmityl alcohol and stearyl alcohol. Other suitable alcohols are, for example, ethylene glycol, propylene glycol, glycerol, polyglycerols having 2 to 8 glycerol units, erythritol, pentaerythritol and sorbitol. The alcohols may, if required, be alkoxylated. Examples of such compounds are the adducts of from 1 to 200 mol of a $C_2$- to $C_4$-alkylene oxide with one mole of an alcohol. Suitable alkylene oxides are, for example, ethylene oxide, propylene oxide and butylene oxides. Ethylene oxide or propylene oxide is preferably used or both ethylene oxide and propylene oxide in the form of blocks are subjected to an addition reaction with the alcohols, it being possible for first a sequence of ethylene oxide units and then a sequence of propylene oxide units to undergo an addition reaction with the alcohols or first propylene oxide and then ethylene oxide to undergo an addition reaction with the alcohols. Random addition of ethylene oxide and propylene oxide and a different arrangement of the blocks in the alkoxylated products are also possible. Of particular interest are, for example, the adducts of from 3 to 20 mol of ethylene oxide with one mole of a $C_{13}/C_{15}$-oxo alcohol or of fatty alcohols. The alcohols can, if required, contain a double bond, an example being oleyl alcohol. Alkoxylated amines which are derived, for example, from the abovementioned amines and are obtainable by reacting ethylene oxide and/or propylene oxide can likewise be used as component (b). Examples are the adducts of from 5 to 30 mol of ethylene oxide with 1 mol of stearylamine, oleylamine or palmitylamine. In addition, suitable components (c) are naturally occurring amino sugars, such as chitosan or chitosamine and compounds which are obtainable from carbohydrates by reductive amination, for example aminosorbitol. The condensates can, if required, contain condensed carbohydrates, such as glucose, sucrose, dextrin, starch and degraded starch, maltose and sugar-carboxylic acids, such as gluconic acid, glutaric acid, glucurolactone and glucuronic acid.

The abovementioned components may be used in the condensation either in the form of the free bases (such as amines) or in the form of the corresponding salts, for example the ammonium salts with inorganic or organic acids. In the case of carboxylic acids, the cocondensable compounds (b) may be used in the condensation in the form of the free carboxylic acids or in the form of their alkali metal, alkaline earth metal or ammonium salts.

The condensation can be carried out in the absence of a solvent, in an organic solvent or in an aqueous medium. Advantageously, the reaction can be carried out in an aqueous medium at concentrations of the compounds of groups (a) and (b) of, for example, from 10 to 98% by weight at from 120 to 300° C. In a particularly preferred embodiment of the process for the preparation of such compounds the condensation is carried out in water at concentrations of components (a) and (b) of from 20 to 70% by weight under superatmospheric pressure at from 140 to 250° C. However, the condensation can also be carried out in an organic solvent, such as dimethylformamide, dimethyl sulfoxide, dimethylacetamide, glycol, polyethylene glycol, propylene glycol, polypropylene glycol, monohydric alcohols, adducts of ethylene oxide and/or propylene oxide with monohydric alcohols, with amines or with carboxylic acids. If aqueous solutions of the reactants (a) and (b) are used as starting materials, the water can, if required, also be distilled off before or during the condensation. The condensation can be carried out under atmospheric pressure with removal of water. Preferably, the water formed in the condensation is removed from the reaction mixture. The condensation can be carried out under superatmospheric, atmospheric or reduced pressure. The duration of the condensation is, for example, from 1 minute to 50 hours, preferably from 30 minutes to 16 hours. The condensates have, for example, molar masses $M_w$ of from 300 to 1,000,000, preferably from 500 to 100, 000.

The condensation can, if required, also be carried out in the presence of mineral acids as catalysts. The concentration of mineral acids is, for example, from 0.001 to 5, preferably from 0.01 to 1% by weight, based on the basic amino acids. Examples of mineral acids suitable as a catalyst are hypophosphorous acid, hypodiphosphoric acid, phosphorous acid, hydrochloric acid, sulfuric acid or mixtures of said acids. The alkali metal, ammonium and alkaline earth metal salts of the acids may also be used as a catalyst.

Crosslinked condensates of basic amino acids are also suitable as polymers for papermaking. Such crosslinked condensates are obtainable, for example, by reacting (i) homocondensates of basic amino acids and/or condensates of at least two basic amino acids and/or cocondensates of basic amino acids and cocondensable compounds with (ii) at least one crosslinking agent having at least two functional groups.

Preferred crosslinking agents (ii) are the following compounds: α,ω-dichloroalkanes or vicinal dichloroalkanes, epihalohydrins, bischlorohydrin ethers of polyols, bischlorohydrin ethers of polyalkylene glycols, esters of chloroformic acid, phosgene, diepoxides, polyepoxides, diisocyanates and polyisocyanates.

Halogen-free crosslinking agents are particularly advantageously used. The halogen-free crosslinking agents are at least bifunctional and are preferably selected from the group consisting of:

(1) ethylene carbonate, propylene carbonate and/or urea, (2) monoethylenically unsaturated carboxylic acids and their esters, amides and anhydrides, at least dibasic saturated carboxylic acids or polycarboxylic acids and the esters, amides and anhydrides derived therefrom in each case, (3) reaction products of polyetherdiamines, alkylenediamines, polyalkylenepolyamines, alkylene glycols, polyalkylene glycols or mixtures thereof with monoethylenically unsaturated carboxylic acids, esters, amides or anhydrides of monoethylenically unsaturated carboxylic acids, the reaction products having at least two ethylenically unsaturated double bonds or carboxamide, carboxyl or ester groups as functional groups, (4) reaction products of dicarboxylic esters with ethyleneimine, which reaction products contain at least two aziridino groups, (5) diepoxides, polyepoxides, diisocyanates and polyisocyanates and mixtures of said crosslinking agents.

Suitable crosslinking agents of group (1) are ethylene carbonate, propylene carbonate and urea. Of this group of monomers, propylene carbonate is preferably used. The crosslinking agents of this group react to give amino-containing urea compounds.

Suitable halogen-free crosslinking agents of group (2) are, for example, monoethylenically unsaturated monocarboxylic acids, such as acrylic acid, methacrylic acid and crotonic acid, and the amides, esters and anhydrides derived therefrom. The esters may be derived from alcohols of 1 to 22, preferably 1 to 18, carbon atoms. The amides are preferably unsubstituted but may carry a $C_1$- to $C_{22}$-alkyl radical as a substituent.

Further halogen-free crosslinking agents of group (2) are at least dibasic saturated carboxylic acids, such as dicarboxylic acids, and the salts, diesters and diamides derived therefrom. These compounds can be characterized, for example, with the aid of the formula

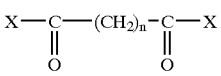

(I), where

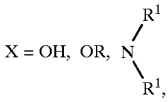

$R = C_1$— to $C_{22}$-alkyl, $R^1 = H$, $C_1$— to $C_{22}$-alkyl and $n = 0$ to 22.

In addition to the dicarboxylic acids of the formula I, for example, monoethylenically unsaturated dicarboxylic acids, such as maleic acid or itaconic acid, are suitable. The esters of the suitable dicarboxylic acids are preferably derived from alcohols of 1 to 4 carbon atoms. Suitable dicarboxylic esters are, for example, dimethyl oxalate, diethyl oxalate, diisopropyl oxalate, dimethyl succinate, diethyl succinate, diisopropyl succinate, di-n-propyl succinate, diisobutyl succinate, dimethyl adipate, diethyl adipate and diisopropyl adipate. Suitable esters of ethylenically unsaturated dicarboxylic acids are, for example, dimethyl maleate, diethyl maleate, diisopropyl maleate, dimethyl itaconate and diisopropyl itaconate. Substituted dicarboxylic acids and their esters, such as tartaric acid (D- and L-form and racemate) and tartaric esters, such as dimethyl tartrate and diethyl tartrate, are also suitable.

Suitable dicarboxylic anhydrides are, for example, maleic anhydride, itaconic anhydride and succinic anhydride. The crosslinking of amino-containing compounds of component (a) with the abovementioned halogen-free crosslinking agents is carried out with the formation of amido groups or, in the case of amides such as adipamide, by transamidation. Maleic esters, monoethylenically unsaturated dicarboxylic acids and their anhydrides can effect crosslinking both by formation of carboxamide groups and by a Michael addition reaction with NH groups of the component to be crosslinked (for example of polyamidoamines).

At least dibasic saturated carboxylic acids include, for example, tri- and tetracarboxylic acids, such as citric acid, propanetricarboxylic acid, ethylenediaminetetraacetic acid and butanetetracarboxylic acid. Suitable crosslinking agents of group (2) are furthermore the salts, esters, amides and anhydrides derived from the abovementioned carboxylic acids.

Other suitable crosslinking agents of group (2) are polycarboxylic acids, which are obtainable by polymerizing monoethylenically unsaturated carboxylic acids or anhydrides. Examples of suitable monoethylenically unsaturated carboxylic acids are acrylic acid, methacrylic acid, fumaric acid, maleic acid and/or itaconic acid. For example, suitable crosslinking agents are polyacrylic acids, copolymers of acrylic acid and methacrylic acid or copolymers of acrylic acid and maleic acid.

Further suitable crosslinking agents (2) are prepared, for example, by polymerizing anhydrides, such as maleic anhydride, in an inert solvent, such as toluene, xylene, ethylbenzene or isopropylbenzene, or solvent mixtures in the presence of free radical initiators. The initiators used are preferably peroxyesters, such as tert-butyl per-2-ethylhexanoate. In addition to the homopolymers, copolymers of maleic anhydride are suitable, for example copolymers of acrylic acid and maleic anhydride or copolymers of maleic anhydride and a $C_2$- to $C_{30}$-olefin.

For example, copolymers of maleic anhydride and isobutene or copolymers of maleic anhydride and diisobutene are preferred. The copolymers containing anhydride groups can, if required, be modified by reaction with $C_1$- to $C_{20}$-alcohols or ammonia or amines and can be used in this form as crosslinking agents.

The molar mass $M_w$ of the homo- and copolymers is, for example, up to 10,000, preferably from 500 to 5000. Polymers of the abovementioned type are described, for example, in EP-A-0 276 464, U.S. Pat. No. 3,810,834, GB-A-1 411 063 and U.S. Pat. No. 4,818,795. The at least dibasic saturated carboxylic acids and the polycarboxylic acids can also be used as crosslinking agents in the form of the alkali metal or ammonium salts. The sodium salts are preferably used. The polycarboxylic acids may be neutralized partly, for example up to 10 to 50 mol %, or completely.

Preferably used compounds of group (2) are dimethyl tartrate, diethyl tartrate, dimethyl adipate, diethyl adipate, dimethyl maleate, diethyl maleate, maleic anhydride, maleic acid, acrylic acid, methyl acrylate, ethyl acrylate, acrylamide and methacrylamide.

Halogen-free crosslinking agents of group (3) are, for example, reaction products of polyetherdiamines, alkylenediamines, polyalkylenepolyamines, alkylene glycols, polyalkylene glycols or mixtures thereof with monoethylenically unsaturated carboxylic acids, esters of monoethylenically unsaturated carboxylic acids, amides of monoethylenically unsaturated carboxylic acids or anhydrides of monoethylenically unsaturated carboxylic acids.

The polyetherdiamines are prepared, for example, by reacting polyalkylene glycols with ammonia. The polyalkylene glycols may contain from 2 to 50, preferably from 2 to 40, alkylene oxide units. These may be, for example, polyethylene glycols, polypropylene glycols, polybutylene glycols or block copolymers of ethylene glycol and propylene glycol, block copolymers of ethylene glycol and butylene glycol or block copolymers of ethylene glycol, propylene glycol and butylene glycol. In addition to the block copolymers, random copolymers of ethylene oxide and propylene oxide and, if required, butylene oxide, are suitable for the preparation of the polyetherdiamines. Polyetherdiamines are furthermore derived from polytetrahydrofurans which have from 2 to 75 tetrahydrofuran units. The polytetrahydrofurans are likewise converted into the corresponding α,ω-polyetherdiamines by reaction with ammonia. Polyethylene glycols or block copolymers of ethylene glycol and propylene glycol are preferably used for the preparation of the polyetherdiamines.

Suitable alkylenediamines are, for example, ethylenediamine, propylenediamine, 1,4-diaminobutane and 1,6-diaminohexane. Suitable polyalkylenepolyamines are, for example, diethylenetriamine, triethylenetetramine, dipropylenetriamine, tripropylenetetramine, dihexamethylenetriamine, aminopropylethylenediamine, bisaminopropylethylenediamine and polyethyleneimines having molar masses of up to 5000. The amines described above are reacted with monoethylenically unsaturated carboxylic acids, esters, amides or anhydrides of monoethylenically unsaturated carboxylic acids so that the products formed have at least 2 ethylenically unsaturated double bonds or carboxamido, carboxyl or ester groups as functional groups. Thus, for example in the reaction of the suitable amines or glycols with maleic anhydride, compounds which can be characterized, for example, with the aid of the formula II:

(II)

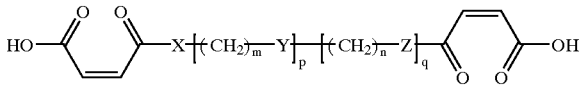

where X, Y and Z are each O or NH and Y is additionally $CH_2$, m, n are each 0–4 and p and q are each 0–45,000, are obtained.

The compounds of the formula (II) are obtainable, for example, by reacting alkylene glycols, polyethylene glycols, polyethyleneimines, polypropyleneimines, polytetrahydrofurans, α,ω-diols or α,ω-diamines with maleic anhydride or with the abovementioned other monoethylenically unsaturated carboxylic acids or carboxylic acid derivatives. The polyethylene glycols suitable for the preparation of the crosslinking agents II preferably have molar masses of from 62 to 10,000, the molar masses of the polyethyleneimines are preferably from 129 to 50,000 and those of the polypropyleneimines from 171 to 50,000. Suitable alkylene glycols are, for example, ethylene glycol, 1,2-propylene glycol, 1,4-butanediol and 1,6-hexanediol.

Preferably used α,ω-diamines are ethylenediamine, and α,ω-diamines derived from polyethylene glycols or from polytetrahydrofurans each having molar masses $M_w$ of from about 400 to 5000.

Particularly preferred crosslinking agents of the formula II are reaction products of maleic anhydride with α,ω-polyetherdiamines having a molar mass of from 400 to 5000, the reaction products of polyethyleneimines having a molar mass of from 129 to 50,000 with the maleic anhydride and the reaction products of ethylenediamine or triethylenetetramine with maleic anhydride in the molar ratio of 1: at least 2. In the reaction of polyalkylene glycols or diols with monoethylenically unsaturated carboxylic acids or their esters, amides or anhydrides, crosslinking agents in which the monoethylenically unsaturated carboxylic acids or their derivatives are linked via an amido group to the polyetherdiamines, alkylenediamines or polyalkylenepolyamines and via an ester group to the alkylene glycols or polyalkylene glycols are formed with retention of the double bond of the monoethylenically unsaturated carboxylic acids or their derivatives. These reaction products contain at least two ethylenically unsaturated double bonds. This type of crosslinking agent undergoes a Michael addition reaction with the amino groups of the compounds to be crosslinked, said addition reaction taking place at the terminal double bonds of these crosslinking agents and possibly additionally with the formation of amido groups.

Polyetherdiamines, alkylenediamines and polyalkylenepolyamines can undergo a Michael addition reaction with maleic anhydride or with the ethylenically unsaturated carboxylic acids or their derivatives also with addition of the double bond. Here, crosslinking agents of the formula III (III),

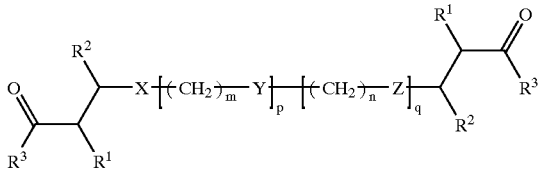

where X, Y and Z are each O or NH and Y is additionally $CH_2$, $R^1$ is H or $CH_3$, $R^2$ is H, COOMe, COOR or $CONH_2$, $R^3$ is OR, $NH_2$, OH or OMe, R is $C_1$- to $C_{22}$-alkyl, Me is H, Na, K, Mg or Ca, m and n are each 0–4 and p and q are each 0–45,000, are obtained.

Via their terminal carboxyl or ester groups, the crosslinking agents of the formula (III) effect crosslinking with the amino-containing compounds with formation of an amido function. This class of crosslinker systems includes the reaction products of monoethylenically unsaturated carboxylic esters with alkylenediamines and polyalkylenepolyamines; for example, the adducts of ethylenediamine, diethylenetriamine, triethylenetetramine, tetraethylenepentamine and polyethyleneimines having molar masses of, for example, from 129 to 50,000 with acrylic or methacrylic esters are suitable, at least 2 mol of the acrylic or methacrylic ester being used per mole of the amine component. The $C_1$- to $C_6$-alkyl esters of acrylic acid or methacrylic acid are preferably used as the esters of monoethylenically unsaturated carboxylic acids. Methyl acrylate and ethyl acrylate are particularly preferred for the preparation of the crosslinking agents. The crosslinking agents which are prepared by a Michael addition reaction of polyalkylene polyamines and ethylenically unsaturated carboxylic acids, esters, amides or anhydrides may have more than two functional groups. The number of these groups depends on the molar ratio in which the reactants are used in the Michael addition reaction. For example, from 2 to 10, preferably from 2 to 8, mol of ethylenically unsaturated carboxylic acids or their derivatives can be subjected to a Michael addition reaction per mole of a polyalkylenepolyamine containing 10 nitrogen atoms. From at least 2 to not more than 4 mol of the ethylenically unsaturated carboxylic acids or their derivatives can be subjected to a Michael addition reaction with, in each case, 1 mol of polyalkylenediamines and alkylenediamines.

When diethylenetriamine and a compound of the formula

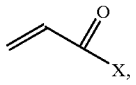

where X is OH, $NH_2$ or $OR^1$ and $R^1$ is $C_1$- to $C_{22}$-alkyl, are subjected to a Michael addition reaction, for example, a crosslinking agent of the structure (IV)

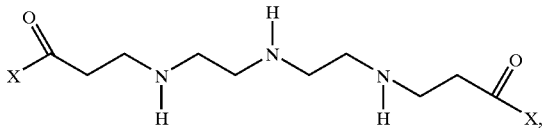

where X is $NH_2$, OH or $OR^1$ and $R^1$ is $C_1$- to $C_{22}$-alkyl, is formed.

The secondary NH groups in the compounds of the formula IV can, if required, undergo a Michael addition reaction with acrylic acid, acrylamide or acrylic esters.

The compounds of the formula II which contain at least 2 carboxyl groups and are obtainable by reacting polyetherdiamines, ethylenediamine or polyalkylenepolyamines with maleic anhydride, or Michael adducts containing at least two ester groups and obtained from polyetherdiamines, polyalkylenepolyamines or ethylenediamine and esters of acrylic acid or methacrylic acid with in each case monohydric alcohols of 1 to 4 carbon atoms, are preferably used as crosslinking agents of group (3).

Suitable halogen-free crosslinking agents of group (4) are reaction products which are prepared by reacting dicarboxylic esters, which have been completely esterified with monohydric alcohols of 1 to 5 carbon atoms, with ethyleneimine. Examples of suitable dicarboxylic esters are dimethyl oxalate, diethyl oxalate, dimethyl succinate, diethyl succinate, dimethyl adipate, diethyl adipate and dimethyl glutarate. Thus, bis[β-(1-aziridino)ethyl]oxalamide is obtained, for example, in the reaction of diethyl oxalate with ethyleneimine. The dicarboxylic esters are reacted with ethyleneimine, for example in a molar ratio of 1 to at least 4. Reactive groups of these crosslinking agents are the terminal aziridino groups. These crosslinking agents can be characterized, for example, with the aid of the formula V:

(V),

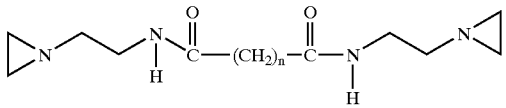

where n is from 0 to 22.

The crosslinking agents described above can be used either alone or as a mixture in the reaction with the above-mentioned water-soluble condensates of basic amino acids. The crosslinking reaction is in all cases only continued as long as the resulting products are still water-soluble; for example, at least 10 g of the crosslinked polymer should dissolve in 1 l of water at 20° C.

The condensates of the basic amino acids are reacted with at least bifunctional crosslinking agents, preferably in an aqueous solution or in water-soluble organic solvents. Suitable water-soluble organic solvents are, for example, alcohols, such as methanol, ethanol, isopropanol, n-propanol and butanols, glycols, such as ethylene glycol, propylene glycol or butylene glycol, or polyalkylene glycols, such as diethylene glycol, triethylene glycol, tetraethylene glycol and dipropylene glycol, and tetrahydrofuran. The concentration of the starting materials in the solvents is chosen in each case so that the resulting reaction solutions contain, for example, from 5 to 50% by weight of crosslinked reaction products. Preferably, the crosslinking is carried out in aqueous solution. The temperatures during the reaction are from 20 to 180° C., preferably from 40 to 95° C. If the reaction temperature is to be above the boiling point of the solvent used in each case, the reaction is carried out under superatmospheric pressure.

These homopolymers and copolymers based on lysine, which may also be referred to as 2,6-diaminohexanoic acid or 2,6-diaminocaproic acid, differ from most conventional process chemicals for papermaking not only in that they are derived from a natural product. After addition to the paper stock, they also have a plurality of different effects and thus differ from the conventional process chemicals and also from those based on the natural product starch. The polymers to be used according to the invention strengthen the paper in the dry as well as the wet state, they increase the retention of the fillers and of the crill, they accelerate the drainage of the paper stock on the wire of the paper machine, they increase the efficiency of anionic retention aids, they help anionic retention aids to achieve a substantial drainage effect, they improve the fixation of anionic paper dyes, and they are capable of fixing undesired anionic oligomers and polymers, which are usually interfering substances, to the paper fibers and hence of removing them from the circulation water of the paper machine. They also increase the absorptivity of the paper.

What is certainly most surprising is that the polymers based on lysine substantially increase the wet strength of the paper. Depending on the papermaking conditions, their wet strength activity is close to or identical to that of the commercial wet strength chemicals, which are reactive synthetic resins from the aminoplast series or resins based on epichlorohydrin, i.e. polyamidopolyamine/epichlorohydrin resins, referred to below as epichlorohydrin resins for short. For ecological and toxicological reasons, there is now a tendency to avoid the use of both resin types because the aminoplasts liberate formaldehyde during and after the processing and moreover display their effect only at low pH in the paper stock, and because, when epichlorohydrin resins are used, it is not possible to avoid organically bound chlorine in the waste water of the paper mill and in the paper produced. The immission of organically bound chlorine, known and measured as "adsorbable organic halogen" (AOX), into the environment should as far as possible be avoided. Both resin types have wet strength activity by virtue of the fact that they react with themselves or with functional groups of the paper fibers and build up a water-resistant network. Their reactivity is also evident from their limited shelf life. The polymers based on lysine are not reactive and to date it has not been possible to explain their wet strength activity on paper.

Wet strength of paper is desired if the paper comes into contact with water unintentionally or contrary to its intended use and should not dissolve or, after drying, should exhibit its original properties again. In such cases, the paper may additionally or alternatively be sized, i.e. rendered partially hydrophobic with a paper chemical, and hence the penetration of water into the fiber structure is slowed down. However, there are many paper grades in which very rapid penetration of water is desirable, it being necessary for the fiber structure to be retained. Examples of such papers are paper hand towels, hygiene papers, paper handkerchiefs, paper napkins, lavatory paper and filter paper. It has surprisingly been found that paper to which wet strength has been imparted by means of polymers based on lysine has very high absorptivity which is higher than that which is obtained with the use of commercial wet strength agents, and also higher than that of paper free of wet strength agents otherwise containing the same raw materials. It is true that those skilled in the art are familiar with methods for increasing the absorptivity of paper, for example by impregnating or spraying the paper web with wetting agents or hydrophilic substances, e.g. polyglycols. However, these known methods reduce the strength of the paper in the dry state. In the novel process, however, the polymeric derivatives of the natural product lysine increase the absorptivity of the paper while at the same time increasing the dry strength.

For many applications, the strength possessed by the paper by virtue of its fiber composition, its filler content and its production process is not sufficient. This is particularly striking in connection with the growing environmental consciousness and the consequently increasing use of waste paper, which has a much lower potential strength than fresh paper fibers. However, even when fresh fibers are used, the natural strength is frequently insufficient, particularly if the paper is to contain a large amount of filler. In such cases, the papermaker attempts to increase the strength of its product by adding specific chemicals. For this purpose, the paper's surface is generally treated with suitable chemicals, preferably with degraded starch, after the actual papermaking. If it is intended to use the strength-imparting starch in the aqueous paper stock, said starch must be reacted with other chemicals in a special chemical process and thus provided with cationic charges. It has surprisingly been found that, also by adding polymers based on the natural product lysine to the aqueous paper stock, according to the novel process, a substantially higher strength can be imparted to the dry paper compared with the paper without strength-imparting chemicals. When used in the stock, they are entirely equivalent therein to the cationic starches but, in contrast to the latter, have a number of further advantages, as described further above and further below.

Many paper grades are colored by adding specific dyes to the aqueous paper stock suspension. It is important that the dyes are absorbed as far as possible completely by the fibers and fillers and do not enter the waste water. This is a problem particularly when particularly popular anionic dyes are employed for coloristic and fastness-relevant reasons. If the waste water is excessively polluted in the case of intensive coloring or if high fastness to bleeding is required, the papermaker attempts to bind such dyes to the fibers and fillers by means of fixing agents, it being necessary to ensure that the hue and the purity of the coloring are not adversely affected by the fixing agent, which nevertheless is very frequently the case. A further problem is the fixing of pigments which are required for the grades which are particularly lightfast and fast to bleeding. Unless aluminum sulfate can be used as the fixing agent, as in traditional papermaking in an acidic medium, these pigments have virtually no intrinsic affinity. It has now surprisingly been found that polycations based on lysine are also capable of binding anionic dyes and pigments to the paper fibers and ensuring substantially colorless waste water, there being no or scarcely any impairment of the coloristic properties of the colored paper.

It is part of the general prior art to add retention aids and drainage aids to the paper stock prior to sheet formation. These are frequently very high molecular weight cationic polymers. The use of high molecular weight anionic polyacrylamides, which have specific ecological advantages, for this purpose is associated, in the case of neutral and alkaline paper stocks, as increasingly used in practice, with the simultaneous use of cationic fixing agents because otherwise the optimum retention effect of the anionic polyacrylamides is not obtained and the drainage of the paper stock may even deteriorate. Polycations based on lysine condensates are capable of optimizing the effect of high molecular weight anionic polyacrylamides with respect to retention and drainage. They not only improve the retention effect of these anionic polymers but also alter the efficiency of the anionic polyacrylamides, resulting in an improvement in the drainage. They are thus superior to commercial fixing agents in both effects. It is noteworthy that the polycations based on lysine condensates also improve the efficiency of high molecular weight cationic polyacrylamides as usually used in papermaking. In addition, they also act by themselves as retention aids and drainage aids, higher molecular weight polycondensates having better efficiency than low molecular weight ones.

It is known that anionic oligomers and polymers which are disadvantageous in papermaking and are therefore referred to as interfering substances accumulate in the circulation water of a paper machine. Such interfering substances impair, for example, the efficiency of cationic retention aids and other polycations by neutralizing their positive charge and thus rendering them ineffective. It has now been found that the polycations based on lysine are also capable of fixing on the paper fibers those anionic oligomers and polymers which occur as interfering substances, and hence rendering them harmless and removing them from the water system of the paper mill.

Those amounts of polymers based on lysine condensates which are required for the effects described vary within wide limits depending on the desired effect but do not differ fundamentally from the amounts of the commercial paper chemicals used for a specific effect in each case. To obtain wet strength, 0.1–5%, preferably 0.5–2, % by weight, based on dry paper stock, of polymers based on lysine should be used. To increase the dry strength of the paper, for example, 0.2–2% by weight, based on dry paper stock, of the lysine polymers are required. For fixing, retention and drainage effects, for example, 0.01–1, preferably 0.02–0.2, % by weight of polylysine derivatives is used, it also being possible to increase the required amounts to 2%, based in each case on dry paper stock, for fixing dyes.

In the examples which follow, percentages are by weight, unless otherwise evident from the context. The K values were determined according to H. Fikentscher, Cellulose-Chemie 13 (1932), 58–64 and 71–74, in aqueous solution at 25° C. and a concentration of 0.5% by weight.

Lysine Polycondensate A:

Condensate of lysine and aminocaproic acid in a molar ratio of 1:1, crosslinked with 30% by weight of a bisglycidyl ether of a polyethylene glycol with 14 ethylene oxide units. Aqueous solution, brought to pH 7.0 with hydrochloric acid. The K value of the polycondensate is 64.5 and the molecular weight $M_w$ is 960,000.

Lysine Polycondensate B:

Condensate of lysine, crosslinked with 30% by weight of a bisglycidyl ether of a polyethylene glycol with 14 ethylene oxide units. Aqueous solution, brought to pH 7.0 with hydrochloric acid. The K value of the polycondensate is 52.2.

Lysine Polycondensate G:

Condensate of lysine, crosslinked with 27% by weight of a bisglycidyl ether of a polyethylene glycol with 14 ethylene oxide units. Aqueous solution, brought to pH 7.0 with HCl. The K value of the polycondensate is 69.

Lysine Polycondensate H:

Condensate of lysine and ϵ-caprolactam in the molar ratio of 1:1, crosslinked with 30% by weight of a bisglycidyl ether of a polyethylene glycol with 14 ethylene oxide units. Aqueous solution, brought to pH 7.0 with HCl. The K value of the polycondensate is 51.0.

Comparative Products:

| | |
|---|---|
| Comparative product I: | commercial polyamidopolyamine/ epichlorohydrin resin having a solids content of 13.5% (Luresin ® KNU from BASF Aktiengesellschaft) |
| Comparative product II: | commercial polydiallyldimethylammonium chloride having a solids content of 30% (Catiofast ® CS from BASF Aktiengesellschaft) |
| Comparative product III: | commercial dicyandiamide resin having a solids content of 45% (Catiofast ® FP from BASF Aktiengesellschaft) |
| Colorant a: | commercial direct dye (C.I. Direct Blue 199) from BASF Aktiengesellschaft: Fastusol ® Blue 75 L |
| Colorant b: | commercial pigment preparation (C.I. Pigment Blue 15.1) from BASF Aktiengesellschaft: Fastusol ® P Blue 58 L |
| Cationic starch I: | cationic potato starch having a degree of substitution of about 0.03 (Hi-Cat 110 from Roquette) |
| Cationic starch II: | cationic potato starch having a degree of substitution of about 0.06 (Hi-Cat 160 from Roquette) |

EXAMPLE 1

In each case the amount, indicated in Table 1, of lysine polycondensate A or of comparative product I is added to a paper stock of unbleached pine sulfate pulp having a freeness of 25° SR and is allowed to act for 1 minute while stirring. 4 sheets having a sheet weight of about 80 g/m$^2$ are then formed for each added amount with the aid of a Rapid-Köthen sheet former. For comparison, paper sheets having a sheet weight of 80 g/m$^2$ are then additionally produced from the paper stock described, in the absence of condensates or conventional paper assistants. After drying by means of a laboratory drying cylinder, the wet breaking length according to DIN 53112-2 and the capillary rise according to ISO 8787 are determined. The test results are shown in Table 1. They show that the wet strength achieved using the polymers based on lysine is similar to that achieved using the products of the prior art. The absorptivity of the paper increases with increasing amount of lysine polycondensate but decreases with increasing amount of epichlorohydrin resin.

TABLE 1

Drying at 90° C. for 10 min; additionally aged for 5 min at 130° C.

| | without wet strength agent | Lysine polycondensate A | | Comparative product I | |
|---|---|---|---|---|---|
| Addition (% of active ingredient, based on dry paper stock) | 0 | 0.5 | 1 | 0.5 | 1 |
| Basis weight (g/m$^2$) | 80.8 | 81.1 | 81.0 | 80.1 | 80.1 |
| Drying at 90° C. | | | | | |
| Wet breaking length (m) | 173 | 645 | 877 | 577 | 841 |
| Drying at 130° C. | | | | | |
| Wet breaking length (m) | 172 | 655 | 885 | 670 | 855 |
| Capillary rise 10 min (mm) | 48 | 59 | 65 | 59 | 48 |

EXAMPLE 2

In each case the amount of lysine polycondensate A or B shown in Table 2 is added to a paper stock of 50 parts of bleached beech sulfite pulp and 50 parts of bleached spruce sulfite pulp having a freeness of 31° SR. 3 sheets having a sheet weight of about 80 g/m$^2$ are then formed for each added amount with the aid of the Rapid-Köthen sheet former. After drying by means of a laboratory drying cylinder, in each case the strengths and the capillary rise are determined. For comparison, paper sheets having a sheet weight of 80 g/m$^2$ are additionally produced from said paper stock in the absence of condensates.

The test results are show n in Table 2. They show that, when polymers based on lysine are used in papermaking, the absorptivity of the paper increases. The paper strength does not decrease but even increases. The polymers based on lysine thus also act as dry strength agents.

TABLE 2

| | | without | Lysine polycondensate B | | Lysine polycondensate A | |
|---|---|---|---|---|---|---|
| Addition (% of active ingredient, based on dry pulp) | | | 0.5 | 1 | 0.5 | 1 |
| Basis weight | g/m$^2$ | 83.6 | 83.4 | 81.8 | 83.1 | 83.3 |
| Dry breaking length | m | 2916 | 3168 | 3455 | 3214 | 3329 |
| Wet breaking length | m | 114 | 408 | 570 | 453 | 568 |
| relative wet strength | % | 4% | 13% | 16% | 14% | 17% |
| Capillary rise 10 min | mm | 53 | 62 | 65 | 64 | 66 |

EXAMPLE 3

The amount of the lysine polycondensates and, for comparison, of the two cationic starches stated in each case in Table 3 is added to a paper stock of 60 parts of bleached pine sulfate pulp and 40 parts of bleached birch sulfate pulp having a freeness of 25° SR. 2 sheets having a sheet weight of about 80 g/m$^2$ are then formed for each added amount with the aid of the Rapid-Köthen sheet former. For comparison, sheets having a basis weight of 80 g/m$^2$ are additionally produced from said paper stock in the absence of further additives. After drying by means of a laboratory drying cylinder, the dry breaking length and the wet breaking length are determined in each case.

The test results are shown in Table 3. They show that the dry paper strength obtained using the polymers based on lysine in papermaking is the same as that obtained using cationic starches. In contrast to the cationic starches, an increase in the wet strength of the paper is additionally obtained with the polylysine derivatives.

TABLE 3

| | | Cationic starch | | Lysine polycondensate | |
|---|---|---|---|---|---|
| | without | I | II | G | B |
| Added amount (% of active ingredient, based on dry paper stock) | | 1 | 1 | 1 | 1 |
| Dry breaking length (m) | 3246 | 3544 | 3447 | 3541 | 3459 |
| Wet breaking length (m) | 109.3 | 106.8 | 108.8 | 444.3 | 390.4 |
| relative wet strength (%) | 3.4 | 3.0 | 3.2 | 12.5 | 11.3 |

EXAMPLE 4

In each case the amounts of fixing compositions or polycondensates of lysine stated in Table 4 are added to one liter of a paper stock beaten to a freeness of 35° SR, having a consistency of 0.6%, comprising 60 parts of bleached birch sulfate pulp and 40 parts of bleached pine sulfate pulp and containing 40 parts of calcium carbonate. The stated amount of a commercial high molecular weight anionic polyacrylamide (Polymin® AE 75 from BASF Aktiengesellschaft) is then added. The paper stock is then drained in a Schopper-Riegler freeness tester, the time in which 600 ml of water flows through the wire of the apparatus being measured. The shorter the time, the greater the drainage effect of the combination of chemicals. The white water which has passed through is subjected to a turbidity measurement. The clearer the white water, the greater the retaining effect of the combination of chemicals. For comparison, a paper sheet which was produced without condensate but in the presence of anionic polyacrylamide is also tested. The test results are shown in Table 4.

They show that, by using lysine polycondensates in papermaking, the retention efficiency of high molecular weight anionic polyacrylamides can be substantially increased, and to a greater extent than with commercial fixing compositions. The results also show that the lysine polycondensates on which the novel process is based impart to the anionic polyacrylamide greater drainage efficiency than the commercial comparative products.

TABLE 4

| | | | | Comparative product | | Lysine polycondensate | |
|---|---|---|---|---|---|---|---|
| | | | | II | III | B | A |
| Addition of fixing composition, | % | 0 | 0 | 0.1 | 0.1 | 0.1 | 0.1 |
| based on dry paper stock anionic PAM | % | | 0.02 | 0.02 | 0.02 | 0.02 | 0.02 |
| Drainage time for 600 ml | sec. | 40 | 47 | 37 | 47 | 31 | 33 |
| Turbidity measured at 588 nm | | 0.976 | 0.327 | 0.142 | 0.184 | 0.086 | 0.096 |

EXAMPLE 5

The procedure is as described in Example 4, except that the polylysine derivatives are compared with two commercial cationic starches. The test results are shown in Table 5. They show that the lysine polycondensates in combination with an anionic polyacrylamide substantially accelerate the drainage of a wood-free paper stock, whereas combinations of cationic starches and anionic polyacrylamide do not do so. Furthermore, it can be seen that said combinations with lysine polycondensates have a better retention effect than combinations with cationic starches.

TABLE 5

| | | | Lysine polycondensate | | | | Cationic starch | | | |
|---|---|---|---|---|---|---|---|---|---|---|
| | | | G | G | H | H | I | I | II | II |
| Addition of fixing composition, | % | | 0.1 | 0.2 | 0.1 | 0.2 | 0.1 | 0.2 | 0.1 | 0.2 |
| based on dry paper stock anionic polyacrylamide | % | — | 0.006 | 0.006 | 0.006 | 0.006 | 0.006 | 0.006 | 0.006 | 0.006 |
| Drainage time for 600 ml | sec. | 31 | 20 | 20 | 24 | 21 | 33 | 33 | 32 | 30 |
| Turbidity measured at 588 nm | | 3.040 | 0.115 | 0.108 | 0.155 | 0.126 | 0.450 | 0.438 | 0.331 | 0.260 |

EXAMPLE 6

The procedure is as in Example 4, except that TMP (thermomechanical pulp) is used as fiber and kaolin (China clay) as filler and a high molecular weight cationic polyacrylamide (Polymin® KE 78 from BASF Aktiengesellschaft) as a retention aid. The test results are shown in Table 6. They show that, by using lysine polycondensates in papermaking, the drainage and retention efficiency of high molecular weight cationic polyacrylamides can be substantially increased, and to a greater extent than with commercial fixing compositions.

TABLE 6

| | | | | Comparative product | | Lysine polycondensate | |
|---|---|---|---|---|---|---|---|
| | | | | II | III | B | A |
| Addition of fixing composition | %[1)] | 0 | 0 | 0.1 | 0.1 | 0.1 | 0.1 |
| cationic PAM | %[1)] | | 0.02 | 0.02 | 0.02 | 0.02 | 0.02 |
| Drainage time for 600 ml | sec. | 70 | 60 | 30 | 55 | 25 | 25 |
| Turbidity measured at 588 nm | | 0.367 | 0.247 | 0.095 | 0.188 | 0.076 | 0.076 |

[1)]based in each case on dry paper stock

EXAMPLE 7

The procedure is as in Example 4, except that the comparative products used are the two cationic starches I and II. The test results are shown in Table 7. They show that, by using lysine polycondensates in papermaking, the drainage and retention efficiency of high molecular weight cationic polyacrylamides can be substantially increased, and to a greater extent than with commercial cation starches.

TABLE 7

| | | | | Lysine polycondensate | | | | Cationic starch | | | |
|---|---|---|---|---|---|---|---|---|---|---|---|
| | | | | G | G | H | H | I | I | II | II |
| Additional fixing composition | %[1)] | | | 0.1 | 0.2 | 0.1 | 0.2 | 0.1 | 0.2 | 0.1 | 0.2 |
| Cationic PAM | %[1)] | — | 0.004 | 0.004 | 0.004 | 0.004 | 0.004 | 0.004 | 0.004 | 0.004 | 0.004 |
| Drainage time for 600 ml | sec. | 55 | 32 | 15 | 13 | 16 | 14 | 25 | 24 | 23 | 23 |
| Turbidity measured at 588 nm | | 1.195 | 0.554 | 0.207 | 0.163 | 0.242 | 0.225 | 0.498 | 0.479 | 0.403 | 0.385 |

[1)]based in each case on dry paper stock

EXAMPLE 8

The procedure is as described in Example 4, except that, instead of high molecular weight cationic polyacrylamide as a retention aid, only various amounts of lysine polycondensates are used. The test results are shown in Table 8. They show that lysine polycondensates have a pronounced drainage and retention efficiency in papermaking, even when used alone.

TABLE 8

Stock model: 100 parts of TMP, beaten to 65°SR + 20 parts of China clay X1
Consistency: 6 g/l

| | | | Lysine polycondensate | | | |
|---|---|---|---|---|---|---|
| | | without | B | | A | |
| Addition, based on dry paper stock | % | 0 | 0.05 | 0.2 | 0.05 | 0.2 |

TABLE 8-continued

Stock model: 100 parts of TMP, beaten to 65°SR + 20 parts of China clay X1
Consistency: 6 g/l

| | | | Lysine polycondensate | | | |
|---|---|---|---|---|---|---|
| | | without | B | | A | |
| Drainage time for 600 ml | sec. | 70 | 41 | 25 | 39 | 21 |
| Turbidity measured at 588 nm | | 0.367 | 0.131 | 0.079 | 0.130 | 0.068 |

EXAMPLE 9

The procedure is as described in Example 4, except that cationic starches are also tested as comparative products. The test results are shown in Table 9. They show that, even when used alone in papermaking, lysine polycondensates have a substantially better drainage and retention efficiency than cationic starches.

TABLE 9

| | | | Lysine polycondensate | | | | Cationic starch | | | |
|---|---|---|---|---|---|---|---|---|---|---|
| | | | G | G | H | H | I | I | II | II |
| Addition of retention aid, based on dry paper stock | % | | 0.2 | 0.4 | 0.2 | 0.4 | 0.2 | 0.4 | 0.2 | 0.4 |
| Drainage time for 600 ml | sec. | 55 | 15 | 13 | 19 | 15 | 50 | 48 | 44 | 38 |
| Turbidity measured at 588 nm | | 1.195 | 0.298 | 0.261 | 0.410 | 0.330 | 1.149 | 1.037 | 0.961 | 0.837 |

EXAMPLE 10

The amounts of sodium ligninsulfonate, cationic polyacrylamide (Polymin® KE 78 from BASF Aktiengesellschaft) and lysine polycondensates stated in Table 10 are added to one liter of a paper stock having a consistency of 0.6% and comprising 50 parts of daily newspapers, 50 parts of liner wastes and 40 parts of kaolin. The paper stock is then drained in a Schopper-Riegler freeness tester for each combination of the stated products, the time in which 500 ml of water flow through the wire of the apparatus being measured. The shorter the time, the greater the drainage effect of the combination of chemicals. The results of the measurements are shown in Table 10.

They show first of all (experiments nos. 1–6) the known effect whereby the essentially good drainage effect of the cationic polyacrylamide is lost through the addition of the interfering substance sodium ligninsulfonate, even if larger amounts of the drainage aid are used. However, if the interfering substance is bound by addition of the polylysine derivatives (experiments nos. 8–11 and 13–16), the cationic polyacrylamide can display its activity again. In the presence of the interfering substance sodium ligninsulfonate, the polylysines alone (experiments 7 and 12) exhibit scarcely any drainage-accelerating effect, even when used in large amounts. The polylysine derivatives can therefore be used for overcoming the effect of interfering substances.

TABLE 10

| | | Experiment no. | | | | | | | | | | | | | | | |
|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 |
| | | | | | | | | Lysine polycondensate A (5) | | | | | Lysine polycondensat G (5) | | | | |
| | | | | | | | | 0.16 | 0.04 | 0.08 | 0.12 | 0.16 | 0.16 | 0.04 | 0.08 | 0.12 | 0.16 |
| Sodium ligninsulfonate | % | — | — | 0.25 | 0.25 | 0.25 | 0.25 | 0.25 | 0.25 | 0.25 | 0.25 | 0.25 | 0.25 | 0.25 | 0.25 | 0.25 | 0.25 |
| Cationic polyacrylamide | % | — | 0.01 | — | 0.01 | 0.02 | 0.04 | — | 0.04 | 0.04 | 0.04 | 0.04 | — | 0.04 | 0.04 | 0.04 | 0.04 |
| Drainage time | sec/500 ml | 95 | 81 | 94 | 86 | 86 | 83 | 85 | 78 | 73 | 66 | 62 | 83 | 79 | 71 | 64 | 56 |

We claim:

1. A process for the production of paper, board or cardboard, said process comprising draining a paper stock in the presence of at least one polymer to form a sheet, wherein said at least one polymer is a crosslinked condensate obtained by reaction of (i) a homocondensate of at least one basic amino acid, a condensate of at least two basic amino acids and/or a condensate of at least one basic amino acid and a cocondensable compound, with (ii) at least one crosslinking agent having at least two functional groups, wherein said at least one basic amino acid, or one of said at least two basic amino acids, is selected from the group consisting of lysine, arginine, ornithine, tryptophan and mixtures thereof.

2. The process as claimed in claim 1, wherein said crosslinking agent (ii) is selected from the group consisting of α,ω-dichloroalkanes, vicinal dichloroalkanes, epihalohydrins, bischlorohydrin ethers of polyols, bischlorohydrin ethers of polyalkylene glycols, esters of chloroformic acid, phosgene, diepoxides, polyepoxides, diisocyanates and polyisocyanates.

3. The process as claimed in claim 1, wherein the condensates are present in amounts of from 0.01 to 5% by weight, based on dry paper stock.

4. The process as claimed in claim 1, wherein the condensates are present in amounts of from 0.02 to 2% by weight, based on dry paper stock, for increasing the dry strength of the paper, for increasing the absorptivity of the paper and for fixing anionic dyes in the paper.

5. The process as claimed in claim 1, wherein the condensates are present in amounts of from 0.02 to 0.2% by weight for fixing interfering substances, for increasing the drainage rate of the paper stock and for increasing the retention of crill and of fillers in papermaking.

6. The process as claimed in claim 1, further comprising adding a synthetic anionic retention aid, wherein the condensates are present in amounts of from 0.02 to 0.2% by weight, based on dry paper stock, for increasing the drainage effect and the retention effect of the synthetic anionic retention aids.

7. The process as claimed in claim 1, further comprising adding a synthetic cationic retention aid, wherein the condensates are present in amounts of from 0.02 to 0.2% by weight, based on dry paper stock for increasing the drainage effect and retention effect of the synthetic cationic retention aids.

8. The process as claimed in claim 1, wherein the at least one basic amino acid, or the one of the at least two basic amino acids, is lysine.

* * * * *